US006840979B2

(12) United States Patent
Fujimaru et al.

(10) Patent No.: US 6,840,979 B2
(45) Date of Patent: Jan. 11, 2005

(54) CLAY COMPOSITION FOR SHAPING NOBLE METAL AND METHOD FOR PRODUCTION OF SINTER OF NOBLE METAL

(75) Inventors: Atsushi Fujimaru, Fuchu (JP); Akiyoshi Yatsugi, Fuchu (JP); Tomoaki Kasukawa, Fuchu (JP)

(73) Assignee: AIDA Chemical Industries Co., Ltd., Tokyo (JP)

( * ) Notice: Subject to any disclaimer, the term of this patent is extended or adjusted under 35 U.S.C. 154(b) by 0 days.

(21) Appl. No.: 10/700,628

(22) Filed: Nov. 5, 2003

(65) Prior Publication Data

US 2004/0139778 A1 Jul. 22, 2004

(30) Foreign Application Priority Data

Nov. 5, 2002 (JP) ..... 2002-320777

(51) Int. Cl.[7] ..... B22F 1/00

(52) U.S. Cl. ..... 75/252; 75/247; 419/23; 419/38

(58) Field of Search ..... 75/252, 247; 419/23, 419/38

(56) References Cited

U.S. PATENT DOCUMENTS

| | | | | | |
|---|---|---|---|---|---|
| 4,689,197 | A | | 8/1987 | Groll et al. | |
| 4,970,050 | A | | 11/1990 | Groll et al. | |
| 5,362,438 | A | * | 11/1994 | van der Zel | 419/28 |
| 5,403,376 | A | * | 4/1995 | DeVolk et al. | 75/255 |
| 5,943,544 | A | * | 8/1999 | Morita et al. | 419/5 |
| 6,110,254 | A | * | 8/2000 | Johnson et al. | 75/741 |
| 6,290,744 | B1 | * | 9/2001 | Fujimaru et al. | 75/247 |
| 6,383,248 | B1 | * | 5/2002 | Taylor et al. | 75/247 |

FOREIGN PATENT DOCUMENTS

| | | |
|---|---|---|
| GB | 1 271 157 | 4/1972 |
| JP | 6-100901 | 4/1994 |
| JP | 7-18302 | 1/1995 |
| JP | 7-70602 | 3/1995 |
| JP | 8-3605 | 1/1996 |
| JP | 8-269503 | 10/1996 |
| JP | 2002-241802 | 8/2002 |

OTHER PUBLICATIONS

Patent Abstracts of Japan: K. Yuichiminagawa et al; Ornamental Gold Powder, Its Production And Method For Applying Gold Powder; Misubishi Shindo KK; JP 6100901, Apr. 12, 1994.

Patent Abstracts of Japan—M. Masakihirasawa et al; Plastic Composition For Molding Noble Metal; Mitsubishi Materials Corp.; JP 7018302; Jan. 20, 1995.

Patent Abstracts of Japan—H. J. Toshinori; Powdery Noble Metallic Stock For Producing Noble Metallic Clay; JP 7070602; Mitsubishi Materials Corp.; Mar. 14, 1995.

Patent Abstracts of Japan—F. Yoichifukui et al; Production Of Monodispersive Noble Metal Powder And The Same Noble Metal Powder; Nortike Co. Ltd.; JP 8003605; Jan. 9, 1996.

Patent Abstracts of Japan—I. Shinicharaki; Clay Composition For Forming Noble Metal And Manufacture Of Noble Metal Sintered Product; JP 8269503; Oct. 15, 1996.

Patent Abstracts of Japan—H. Juichi et al.; Silver Powder For Silver Clay Having Excellent Low Temperature Sinterability And Silver Clay Containing The Silver Powder; Mitsubishi Materials Corp.; JP 2002–241802, Aug. 28, 2002.

Patent Abstracts of Japan—I. Yasuo; Silver Powder For Silver Clay And Silver Clay Comprising The Silver Powder; Mitsubishi Materials Corp.; WO 03/028927, Aug. 28, 2002.

* cited by examiner

*Primary Examiner*—Ngoclan T. Mai
(74) *Attorney, Agent, or Firm*—Breiner & Breiner, L.L.C.

(57) ABSTRACT

A clay composition for shaping noble metal is formed of a kneaded mixture of a mixed powder of noble metal having as main components thereof 30 to 70% by weight of a powder having an average particle diameter in the range of 2.2 to 3.0 $\mu$m and 70 to 30% by weight of a powder having an average particle diameter in the range of 5 to 20 $\mu$m with an aqueous solution of an organic binder.

5 Claims, No Drawings

CLAY COMPOSITION FOR SHAPING NOBLE METAL AND METHOD FOR PRODUCTION OF SINTER OF NOBLE METAL

FIELD OF THE INVENTION

This invention relates to a clay composition for shaping noble metal which can be used as a raw material for manufacturing shaped articles of noble metal with profound elements of industrial art, such as jewels of noble metal, articles of fine art and decorative trims, and can be sintered with only minimal shrinkage and to a method for the production of sinters of noble metal.

BACKGROUND OF THE INVENTION

Recently, in the creation of shaped articles of noble metal with profound elements of industrial art, the practice of producing the shaped articles of noble metal aimed at by using a clay composition having the noble metal in a powdered form and an organic binder as basic components, shaping the clay composition in a predetermined form, drying the shaped clay composition and sintering the dry shaped article, thereby removing the binder composition as by dint of decomposition, vaporization or combustion, and inducing cohesion of the adjacent particles of the powdered noble metal has been in vogue.

As the conventional product mentioned above, the clay composition for shaping noble metal has been known to comprise a powdered noble metal having an average particle diameter in the range of 5 to 30 $\mu$m and containing as a main portion such particles of diameters as fall in the range of 1 to 100 $\mu$m and an organic binder formed of 0.02 to 3.0 wt % of starch and 0.02 to 3.0 wt % of a water-soluble cellulose resin.

A study that has substantiated low-temperature sintering by using powdered noble metals having different particle diameters has been proposed as disclosed in JP-A 2002-241802, for example.

The conventional clay composition for forming noble metal as described above, however, is such that while it has acquired fully satisfactory strength and restrained shrinkage successfully to a duly low level when it is sintered in a temperature range from the melting point of the noble metal to a temperature 250° C. lower than the melting point, it has been unable to acquire fully satisfactory strength when it is sintered at a temperature lower than the temperature range mentioned above. When an electric furnace that is capable of retaining the clay composition at a duly high temperature is used, it is made possible to acquire a sinter having fully satisfactory strength. The electric furnace of such a capacity as this, however, is very expensive. In contrast, an electric furnace for household use is small and simple and is mostly rather deficient in the ability to heat and in the control of temperature. Thus, it has been incapable of retaining the interior of the furnace at a high temperature or controlling the temperature accurately and, therefore, has failed at times to permit production of a sinter possessing fully satisfactory strength. For the sake of enabling the clay composition for shaping noble metal to produce a sinter having fully satisfactory strength, it has been necessary to widen the range of the sintering temperature adopted for it.

It has been heretofore known that this range of temperature can be widened by using a plurality of powders having different average particle diameters as found in the clay composition disclosed in JP-A 2002-241802 mentioned above. At least the clay composition of this publication, however, inevitably results in aggravating the shrinkage (shrinkage of about 12 to 20%) due to sintering. During the shaping of a form, therefore, it has been necessary to increase the size of this form by estimating the size obtained subsequent to the sintering, namely by giving due allowance for the shrinkage expected to take place. Especially when a product combining a ceramic and various decorative parts of metals is to be manufactured, an unduly large estimate of the shrinkage has possibly resulted in causing the decorative parts to loosen and fall off the clay part prior to the sintering. Conversely an unduly small estimate of this shrinkage results in preventing the shaping from producing a form aimed at and consequently suffering it to yield a warped form instead and eventually disrupting the pleasure of the shaping because the part of the clay adjoining the decorative parts deforms as by protuberating with a large shrinkage.

This invention is aimed at eliminating such problems as enumerated above and providing a clay composition for shaping noble metal that sinters effectively at temperatures in a wide range and induces only small shrinkage due to the sintering.

SUMMARY OF THE INVENTION

The clay composition of this invention for shaping noble metal is formed of a kneaded mixture of a mixed powder of noble metal having as main components thereof 30 to 70% by weight of a powder having an average particle diameter in the range of 2.2 to 3.0 $\mu$m and 70 to 30% by weight of a powder having an average particle diameter in the range of 5 to 20 $\mu$m and an aqueous organic binder solution. For the sake of convenience, the term "% by weight" as used in the present specification is intended to refer to the weight percentage in the mixed powder of noble metal and the term "wt %" to the weight percentage in the clay composition for shaping noble metal.

This invention is aimed further at providing a method for producing a sinter of noble metal, comprising the steps of shaping the clay composition for shaping noble metal mentioned above, thereby obtaining a shaped form of clay, drying the shaped form of clay, and sintering the dry shaped form at a temperature in the range of from the melting point of the noble metal mixture used to a temperature 360° C. lower than the melting point for a duration of five minutes.

By mixing a plurality of kinds of noble metal powders having different average particle diameters as described above, it is made possible to acquire a sinter of high density and lower the degree of shrinkage even when the sintering temperature is set at a level 360° C. lower than the melting point of the noble metal because smaller particles intervene between the large particles and fill in the voids.

DESCRIPTION OF THE PREFERRED EMBODIMENT

The mixed powder of noble metal to be used in this invention comprises at least one member selected from the group consisting of pure noble metal powders, such as of gold, platinum, palladium and silver, and alloy powders having such elements as main components thereof and is a mixture formed of 30 to 70 wt % of a powder having an average particle diameter in the range of 2.2 to 3.0 $\mu$m and the balance of a powder having an average particle diameter in the range of 5 to 20 $\mu$m.

It has been ascertained that by combining the plurality of kinds of powders having different particle diameters as described above, the resultant clay composition is enabled to be fired at a relatively low temperature, that by allowing small particles (hereinafter referred to as "fine particles") to intervene between large particles (hereinafter referred to as "giant particles") and causing the fine particles to fill in the gaps between the giant particles, the produced sinter of noble metal is enabled to acquire high density and show only a low degree of shrinkage, and that particularly by specifying the average particle diameters and the contents for the fine particles and the giant particles, the resultant clay composition is enabled to sinter effectively in a range from the melting point to the temperature 360° C. lower than the melting point, repress the degree of shrinkage due to the sintering to below 10% (in length), and defy breakage and yet succumb to bending.

The fine particles of noble metal to be used in this invention are those that have an average particle diameter in the range of 2.2 to 3.0 μm as described above. If fine particles having an average particle diameter falling short of 2.2 μm are used, the total surface area of such fine particles will unduly increase and the amount of organic binder required to cover the surface will proportionately increase and eventually the resultant clay composition will induce unduly large shrinkage. When the shrinkage is increased, it has become necessary to add to the size of a form to be shaped by assuming the size of the form subsequent to the sintering, namely granting a due allowance for the prospective shrinkage as described above. Then, in the case of manufacturing a product combining a ceramic and various decorative parts of metal, for example, there are times when the product is not obtained in a shape aimed at but in a warped shape because of the possibility that the decorative parts will come off the clay part and roll down prior to the firing when the estimate of the shrinkage is unduly large or the part of the clay adjoining the decorative parts will copiously protuberate even to the extent of warping the shaped form in consequence of a large shrinkage when the estimate of the shrinkage is unduly small. Further, it is not improbable that the product will be obtained in a form different from the image envisioned during the course of shaping the form. Thus, the mishap results in disrupting the pleasure of the shaping of a mold, for example. When fine particles having an average particle diameter exceeding 3.0 μm are used, the resultant clay composition is no longer capable of producing a sinter of high density because the difference in size of these fine particles from giant particles decreases so much as to render the sintering at such a low temperature as mentioned above ineffectual.

If the proportion of fine particles having an average particle diameter in the range of 2.2 to 3.0 μm falls short of 30% by weight, the produced sinter will no longer capable of acquiring high density because the sintering at the low temperature mentioned above is not effected. Only the sintering at a high temperature infallibly results in producing a sinter enjoying low shrinkage and high strength. If the proportion exceeds 70% by weight, the combination with decorative parts mentioned above will encounter inconveniences and the finish of the product will differ from the image envisioned during the course of shaping a form because the degree of shrinkage exceeds 10%. The sintering at a high temperature aggravates the shrinkage.

The giant particles of noble metal to be used in this invention are those that have an average particle diameter in the range of 5 to 20 μm as described above. If giant particles having an average particle diameter falling short of 5 μm are used, the sintering at a low temperature will no longer be attained because the difference in size of these giant particles from fine particles becomes unduly small. When giant particles having particle diameters exceeding 20 μm are used, the density acquired by the resultant sinter will become partially heterogeneous. The proportion of giant particles having an average particle diameter in the range of 5.0 to 20 μm falls in an approximate range of 70 to 30% by weight, through depending on the proportion of fine particles mentioned above.

If fine particles having an average particle diameter of not more than 2 μm are used as taught in the publication cited above, for example, the shrinkage by the sintering will become unduly large (shrinkage of about 12 to 20%) as mentioned above. If the shrinkage is thus large, the finish of the resultant product will of course differ from the image envisioned during the course of shaping a form and the manufacture of a product combined with decorative parts will suffer the decorative parts to separate from the clay part and roll down or the clay part to sustain warp.

The invention of the publication cited above embraces an embodiment using giant particles having unduly large diameters. In the case of this embodiment, the density of the produced sinter will become partially heterogeneous. The invention also embraces an embodiment allowing the particle diameters of fine particles and giant particles to approximate very closely. In the case of this embodiment, the sintering at a low temperature will not be attained and the produced sinter will fail to acquire high density.

The particles of the noble metal powder mentioned above do not need to be limited to particular shapes, such as spheres, aggregates and teardrops. A high-density powder containing voids therein at a low percentage is used preferably. When the powder produced by the wet method is used, for example, it interiorly abounds in voids such that the particles thereof, while the clay composition is being sintered, undergo thermal fusion and verge on the formation of spheres by virtue of surface tension and the voids therein tend to gain in density as they are filled with molten metal. Thus, the apparent volume of this powder decreases and the degree of shrinkage increases.

Then, the mixed powders of noble metal are preferred to account for a proportion in the range of 75 to 99 wt % when they are mixed and kneaded with an organic binder and water to form a clay composition. If the amount of the mixed powders of noble metal falls short of 75 wt %, the produced clay composition will become too soft to be easily handled because the amounts of the organic binder and the water proportionately increase. If the amount exceeds 99 wt %, the produced clay composition will be deficient in shaping ability and will encounter difficulty in retaining the shape thereof.

The organic binder to be used in this invention is preferred to contain starch and water-soluble cellulose resin as shown below.

Starch occurs in two types, i.e. β-starch that shows no solubility in cold water, lacks viscosity and does not easily succumb to digestion or decomposition by an enzyme and α-starch which shows solubility even in cold water. When the β-starch generally insoluble in cold water is heated in the presence of water, the particles thereof begin swelling, come to acquire viscosity and eventually assume a uniform transparent or translucent pasty form. This state constitutes itself the so-called α-transformation. The outcome of this transformation is called α-starch. This α-starch is quickly dehydrated and dried and the resultant dry mass is pulverized to obtain α-form starch. It quickly dissolves in cold water and gives rise to a pasty liquid. The starch in either of the types can be used in this invention.

The starch enhances the dry strength of a shaped form of clay when the form is dried. When the organic binder uses the starch alone, the clay sustains a crack in the texture thereof while the clay is being shaped and the clay composition tends to adhere to a hand. This problem can be solved using the starch in combination with a water-soluble cellulose resin. If the content of this starch is less than 0.02 wt %, the shortage will induce insufficiency of strength when the clay is dried and render the shaped form readily breakable during the release from the mold. If the content exceeds 3 wt %, the excess will cause the clay to manifest resilience, prevent it from being easily shaped in an expected form and sustain a crack in the texture thereof. It also adds to the degree of shrinkage.

If the water-soluble cellulose resin accounts for a proportion falling short of 0.02 wt %, the shortage will keep the resin from manifesting an effect of preventing crack of texture and from sufficiently manifesting an effect of preventing the clay from adhering to a hand. If the proportion exceeds 3 wt %, the excess will render the clay again easy to adhere to a hand and cause the clay to add to acquire an increased degree of shrinkage. As concrete examples of the water-soluble cellulose resin of this quality fit for use herein, methyl cellulose, hydroxyethyl cellulose, hydroxypropyl cellulose, hydroxypropylmethyl cellulose, etc. may be cited. The resin is used as dissolved in water.

The amount of the organic binder that contains the starch and the water-soluble cellulose resin is preferred to be in the range of 0.1 to 4 wt %. If the amount of the organic binder falls short of 0.1 wt %, the shortage will result in suffering the clay to betray deficiency in shaping property and encounter difficulty to retain the shape thereof. It will further entail such inconveniences as weakening the strength of the clay subsequent to the steps of shaping and drying. Conversely, if the amount of the organic binder exceeds 4 wt %, the excess will result in suffering the clay to succumb to aggravation of shrinkage and gain in adhesiveness to a hand. The clay in this condition, when shaped in a form, will fail to succumb to perfect plastic deformation, reveal resilience and encounter difficulty in being shaped to an expected form.

It is expected that water should be added in an amount necessary at all. If the amount is unduly small, the clay will become unduly hard. If the amount is unduly large, the clay will become too soft to be easily handled and add to the adhesiveness thereof to a hand. When the clay is dried, it entails a decrease in volume proportionate to the loss of the water and induces an addition to the degree of shrinkage subsequent to the step of sintering.

As one example of manufacturing a clay composition of this invention for shaping noble metal by using the components described above, first an aqueous organic binder solution can be produced by having cellulose and starch of different dissolving conditions thoroughly mixed in the form of a powder, placing the powder in warm water, dispersing and heating the resultant mixture, thereby first dissolving β-starch and subsequently allowing the hot mixture to cool off to dissolve cellulose as well. Optionally, the clay composition can be produced through the steps of dispersing the powder in cold water to dissolve cellulose and subsequently heating the cold mixture to dissolve β-starch. Next, a clayish substance can be obtained through thorough mixing of the aqueous organic binder solution prepared as described above and powders of noble metal at a prescribed ratio and thorough kneading of the same.

The clayish substance thus obtained is shaped into a desirable shape and then sintered. The sintering is performed at a temperature in the range of the melting point of the noble metal to a temperature 360° C. lower than the melting point for a period of 5 to 30 minutes. If the period exceeds 30 minutes, the degree of shrinkage exceeds 10%, which is not desirable.

As described above, according to the present invention, using giant particles having an average particle diameter of 5 to 20 μm and fine particles having an average particle diameter of 2.2 to 3.0 μm mixed in a predetermined ratio and performing sintering at a temperature 360° C. lower than the melting point of the mixture for a period of 5 minutes enables sinters of noble metal having a shrinkage degree of not more than 10% to be produced with good repeatability.

Now, working examples of this invention will be shown below.

The evaluations shown in Tables 1 to 6 represent the results of a test for bending strength, which fall under two grades, i.e. one grade of the mark "O" indicating that the relevant test pieces were bent and not broken under the conditions of not more than 10% in degree of shrinkage and not less than 10 kgf/mm$^2$ in bending strength and the other grade of the mark "X" indicating that the relevant test pieces were broken under the conditions of not less than 10% in degree of shrinkage or not more than 10 kgf/mm$^2$ in bending strength.

EXAMPLE 1

A clay composition was obtained by mixing 92 wt % of a mixed powder of silver consisting of 50% by weight (46 wt %) of powdered silver having an average particle diameter of 2.5 μm and 50% by weight (46 wt %) of powdered silver having an average particle diameter of 20 μm with a water-soluble binder consisting of 0.7 wt % of starch, 0.8 wt % of cellulose and the balance of water. This clay composition was molded to form test pieces measuring 50 mm in length×10 mm in width×1.5 mm in thickness and the test pieces were fired under the following conditions. Methyl cellulose (made by Shin-etsu Chemical Industry Co., Ltd. and sold under the trademark designation of "Methlose SM8000") was used as the cellulose, and β-potato starch (made by Nichiden Kagaku K.K. and sold under the trademark designation of "DELICA M-9") was used as the starch.

TABLE 1

| Firing Conditions | Degree of Shrinkage (%) | Bending Strength (kgf/mm$^2$) | Break/Bend | Evaluation |
|---|---|---|---|---|
| 590° C. & 5 min | 5.9 | 9.87 | Break | X |
| 590° C. & 30 min | 6.0 | 9.91 | Break | X |
| 600° C. & 5 min | 6.7 | 12.57 | Bend | ○ |
| 600° C. & 30 min | 7.8 | 33.81 | Bend | ○ |
| 650° C. & 5 min | 7.9 | 31.21 | Bend | ○ |
| 650° C. & 30 min | 8.2 | 37.16 | Bend | ○ |
| 850° C. & 5 min | 9.5 | 38.74 | Bend | ○ |

The results show that the test pieces using the conditions of 590° C. and 5 minutes and those of 590° C. and 30 minutes revealed insufficiency of strength and sustained breakage.

The test pieces using the other conditions showed degrees of shrinkage of not more than 10% and sustained bend but no break.

COMPARATIVE EXAMPLE 1

A clay composition was obtained by mixing 92 wt % of a mixed powder of silver consisting of 81.5% by weight (75 wt %) of powdered silver having an average particle diameter of 2.5 μm and 18.5% by weight (17 wt %) of powdered silver having an average particle diameter of 20 μm with a water-soluble binder consisting of 0.7 wt % of starch, 0.8 wt % of cellulose and the balance of water. This clay composition was molded to form test pieces measuring 50 mm in length×10 mm in width×1.5 mm in thickness and the test pieces were fired under the following conditions.

TABLE 2

| Firing Conditions | Degree of Shrinkage (%) | Bending Strength (kgf/mm$^2$) | Break/Bend | Evaluation |
|---|---|---|---|---|
| 590° C. & 5 min | 8.5 | 9.43 | Break | X |
| 590° C. & 30 min | 9.7 | 9.68 | Break | X |
| 600° C. & 5 min | 11.5 | 24.32 | Bend | X |
| 600° C. & 30 min | 12.4 | 37.67 | Bend | X |

The results show that the degree of shrinkage exceeded 10% under the conditions of 600° C. and 5 minutes.

COMPARATIVE EXAMPLE 2

A clay composition was obtained by mixing 92 wt % of a mixed powder of silver consisting of 32.6% by weight (30 wt %) of powdered silver having an average particle diameter of 1.5 μm and 67.4% by weight (62 wt %) of powdered silver having an average particle diameter of 20 μm with a water-soluble binder consisting of 0.7 wt % of starch, 0.8 wt % of cellulose and the balance of water. This clay composition was molded to form test pieces measuring 50 mm in length×10 mm in width×1.5 mm in thickness and the test pieces were fired under the following conditions.

TABLE 3

| Firing Conditions | Degree of Shrinkage (%) | Bending Strength (kgf/mm$^2$) | Break/Bend | Evaluation |
|---|---|---|---|---|
| 590° C. & 5 min | 8.3 | 9.13 | Break | X |
| 590° C. & 30 min | 9.2 | 9.53 | Break | X |
| 600° C. & 5 min | 11.8 | 24.32 | Bend | X |
| 600° C. & 30 min | 13.1 | 38.74 | Bend | X |

The results show that the degree of shrinkage exceeded 10% under the conditions of 600° C. and 5 minutes.

EXAMPLE 2

A clay composition was obtained by mixing 94 wt % of a mixed powder of gold consisting of 50% by weight (47 wt %) of powdered gold having an average particle diameter of 2.5 μm and 50% by weight (47 wt %) of powdered gold having an average particle diameter of 20 μm with a water-soluble binder consisting of 0.5 wt % of starch, 0.6 wt % of cellulose and the balance of water. This clay composition was molded to form test pieces measuring 50 mm in length×10 mm in width×1.5 mm in thickness and the test pieces were fired under the following conditions.

TABLE 4

| Firing Conditions | Degree of Shrinkage (%) | Bending Strength (kgf/mm$^2$) | Break/Bend | Evaluation |
|---|---|---|---|---|
| 690° C. & 5 min | 5.9 | 7.98 | Break | X |
| 690° C. & 30 min | 5.9 | 8.12 | Break | X |
| 700° C. & 5 min | 6.7 | 10.88 | Bend | ○ |

TABLE 4-continued

| Firing Conditions | Degree of Shrinkage (%) | Bending Strength (kgf/mm$^2$) | Break/Bend | Evaluation |
|---|---|---|---|---|
| 700° C. & 30 min | 7.8 | 24.74 | Bend | ○ |
| 750° C. & 5 min | 7.9 | 28.86 | Bend | ○ |

The results show that test pieces using the conditions of 690° C. and 5 minutes and those of 690° C. and 30 minutes were broken owing to insufficiency of strength.

The other test pieces showed degrees of shrinkage of not more than 10% and sustained no break.

COMPARATIVE EXAMPLE 3

A clay composition was obtained by mixing 94 wt % of a mixed powder of gold consisting of 79.8% by weight (75 wt %) of powdered gold having an average particle diameter of 2.5 μm and 20.2% by weight (19 wt %) of powdered gold having an average particle diameter of 20 μm with a water-soluble binder consisting of 0.5 wt % of starch, 0.6 wt % of cellulose and the balance of water. This clay composition was molded to form test pieces measuring 50 mm in length×10 mm in width×1.5 mm in thickness and the test pieces were fired under the following conditions.

TABLE 5

| Firing Conditions | Degree of Shrinkage (%) | Bending Strength (kgf/mm$^2$) | Break/Bend | Evaluation |
|---|---|---|---|---|
| 690° C. & 5 min | 9.3 | 8.43 | Break | X |
| 690° C. & 30 min | 9.7 | 9.68 | Break | X |
| 700° C. & 5 min | 11.2 | 22.12 | Bend | X |
| 700° C. & 30 min | 13.2 | 28.47 | Bend | X |

The results show that the degree of shrinkage exceeded 10% under the conditions of 700° C. and 5 minutes.

COMPARATIVE EXAMPLE 4

A clay composition was obtained by mixing 94 wt % of a mixed powder of gold consisting of 31.9% by weight (30 wt %) of powdered gold having an average particle diameter of 1.5 μm and 68.1% by weight (64 wt %) of powdered gold having an average particle diameter of 20 μm with a water-soluble binder consisting of 0.5 wt % of starch, 0.6 wt % of cellulose and the balance of water. This clay composition was molded to form test pieces measuring 50 mm in length×10 mm in width×1.5 mm in thickness and the test pieces were fired under the following conditions.

TABLE 6

| Firing Conditions | Degree of Shrinkage (%) | Bending Strength (kgf/mm$^2$) | Break/Bend | Evaluation |
|---|---|---|---|---|
| 690° C. & 5 min | 8.5 | 7.86 | Break | X |
| 690° C. & 30 min | 9.1 | 8.89 | Break | X |
| 700° C. & 5 min | 10.8 | 24.61 | Bend | X |
| 700° C. & 30 min | 12.3 | 26.84 | Bend | X |

The results show that the degree of shrinkage exceeded 10% under the conditions of 700° C. and 5 minutes.

The present invention has been described in the foregoing with reference to the Examples. However, the present invention is not limited to the Examples and can be modified without departing from the spirit of the invention described in the appended claims.

As has been described in the foregoing, the present invention can provide a clay composition for shaping noble metal and a method for the production of a sinter of noble metal. The sinter can be produced at a temperature 360° C. lower than the melting point of powder of noble metal, and the sinter thus produced has high density and low shrinkage. Widening the sintering temperature range enables sintering to be performed using a simple sintering furnace and inexpensive equipment without requiring management of a fine temperature elevation profile. The sintering in the low-temperature range enables reduction of energy cost.

What is claimed is:

1. A clay composition for shaping noble metal comprising a kneaded mixture of a mixed powder of noble metal including about 30 to 70% by weight of a powder having an average particle diameter in a range of about 2.2 to 3.0 $\mu$m and about 70 to 30% by weight of a powder having an average particle diameter in a range of about 5 to 20 $\mu$m with an aqueous solution of an organic binder.

2. The clay composition according to claim 1, wherein said organic binder comprises about 0.02 to 3.0 wt % of starch and about 0.02 to 3.0 wt % of a water-soluble cellulose resin.

3. The clay composition according to claim 1, wherein said organic binder accounts for a proportion in a range of about 0.1 to 4 wt %.

4. The clay composition according to claim 2, wherein said organic binder accounts for a proportion in a range of 0.1 to 4 wt %.

5. A method for producing a sinter of noble metal comprising shaping a clay composition for shaping noble metal according to claim 1, 2, 3 or 4 in a predetermined form to obtain a shaped form of clay, drying the shaped form of clay, and sintering the dry shaped form of clay at a temperature in a range from a melting point of the mixed powder of noble metal to a temperature 360° C. lower than the melting point for a duration of five minutes.

* * * * *